United States Patent [19]

Chung et al.

[11] Patent Number: 4,813,545

[45] Date of Patent: Mar. 21, 1989

[54] RECTANGULAR PAPERBOARD PACKAGE

[75] Inventors: Yun H. Chung; Dennis E. Chung, both of Maumee, Ohio

[73] Assignee: MPR Corporation, Perrysburg, Ohio

[21] Appl. No.: 195,367

[22] Filed: May 13, 1988

Related U.S. Application Data

[63] Continuation of Ser. No. 887,562, Jul. 17, 1986, abandoned.

[51] Int. Cl.[4] ..... B65D 5/54

[52] U.S. Cl. ..... 206/621; 206/611; 206/628; 206/634

[58] Field of Search ..... 206/634, 601, 605, 607, 206/608, 611, 620, 621, 491, 628; 229/16 R, 17 R, 3.1

[56] References Cited

U.S. PATENT DOCUMENTS

| | | | |
|---|---|---|---|
| 2,470,388 | 5/1949 | Ball . | |
| 3,041,941 | 7/1962 | Karl-Heinz Danielzig . | |
| 3,083,876 | 4/1963 | Schneider et al. . | |
| 3,089,298 | 5/1963 | Neuendorf et al. . | |
| 3,214,079 | 10/1965 | Andrews et al. . | |
| 3,270,941 | 9/1966 | Barnes | 206/621 |
| 3,355,089 | 11/1967 | Champlin . | |
| 3,357,631 | 12/1967 | Aid et al. . | |
| 3,438,565 | 4/1969 | Lugt et al. . | |
| 4,043,503 | 8/1977 | Meyers et al. . | |
| 4,168,003 | 9/1979 | Wysocki | 206/611 |
| 4,244,474 | 1/1981 | Wise . | |
| 4,397,415 | 8/1983 | Lisiecki | 206/628 |
| 4,405,078 | 9/1983 | Dutcher et al. | 206/621 |
| 4,411,365 | 10/1983 | Horikawa et al. . | |
| 4,498,581 | 2/1985 | Dutcher . | |
| 4,520,930 | 6/1985 | Lisiecki | 206/628 |
| 4,546,884 | 10/1985 | Kuchenbecker . | |
| 4,613,046 | 9/1986 | Kuchenbecker | 229/17 R |

*Primary Examiner*—Willis Little

*Attorney, Agent, or Firm*—MacMillan, Sobanski & Todd

[57] ABSTRACT

A rectangular paperboard package is fabricated from a single precut and prescored blank of paperboard material. The package includes a top panel having first and second side panels having upper edges connected to opposite parallel edges of the top panel. The first and second side panels are each provided with front extension portions which cooperate to define a front panel and are sealingly connected to define a vertically extending front fin seal. The side panels are further provided with rear extension portions which cooperate to define a rear panel and are sealingly connected to define a vertically extending rear fin seal. The top panel includes front and rear extension portions which cooperate with upper extension portions of the front and rear panels to define front and rear top fin seals. The bottom panel of the package is formed by cooperating lower extension portions of the first and second side panels which define an intermediate bottom fin seal. The bottom panel includes front and rear extension portions which cooperate with lower extension portions of the front and rear panels to define front and rear bottom fin seals. The various extension portions are designed to effectively protect each associated fin seal, to provide smooth planar surfaces for printing purposes, and to increase the overall rigidity of the package. Also, the preferred embodiment of the package is provided with a unique tear away opening feature. The package can be utilized to package a wide variety of products including liquid drinks, frozen concentrated drinks, motor oil, granular material, and containers which have previously been filled with a product.

69 Claims, 8 Drawing Sheets

RECTANGULAR PAPERBOARD PACKAGE

This is a continuation of Ser. No. 887,562 filed 7/16/86, now abandoned.

BACKGROUND OF THE INVENTION

The present invention relates generally to a rectangular paperboard package which is formed from a single sheet of paperboard material and, in particular, to a package which is capable of holding a liquid product and is provided with an easy open, tear away top portion. The present invention also concerns a unique blank structure for constructing the paperboard package.

Paperboard materials are becoming increasingly popular as a packaging material, especially in the food industry. A sheet of paperboard material typically includes a central structural layer of paper to provide strength and rigidity to the associated package. In some instances, a layer of aluminum foil can be adhered to one surface of the paperboard to serve as a barrier layer against the passage of contaminates into the package. Generally, both surfaces of the paperboard/foil combination are then coated with a heat sealable thermoplastic material. While a number of specific constructions are known, it is generally accepted practice to fold a precut and prescored sheet of paperboard material into a predetermined package configuration, and to seal the packages by applying heat and pressure to certain contacting surfaces of the paperboard.

Many types of paperboard packages capable of holding a liquid and provided with some type of opening means have been proposed. Examples of such packages are disclosed in U.S. Pat. Nos. 3,347,444; 4,317,518; 4,520,929; and 4,546,884. While the packages disclosed in these patents have been found to be satisfactory for certain packaging applications, there has been a need in the industry for a rectangular paperboard package which is capable of holding liquid and which can be produced on an economical basis.

SUMMARY OF THE INVENTION

The present invention relates to a rectangular paperboard package which is fabricated from a single precut and prescored sheet of paperboard material. The package can be utilized to package a wide variety of products including liquid drinks, frozen concentrated drinks, motor oil, granular or pulverized material, and containers which have been previously filled with a product.

More specifically, the package includes a rectangular top panel and first and second side panels having upper marginal edges connected to first and second opposite side marginal edges of the top panel. The first and second side panels are each provided with a front extension portion extending therefrom. The front extension portions cooperate to define a front panel and are sealingly connected to one another to define a vertically extending front fin seal. The first and second side panels are further provided with rear extension portions which cooperate to define a rear panel and are sealingly connected to define a vertically extending rear fin seal.

In accordance with the present invention, one of the front extension portions is adapted to extend outwardly past its associated front fin seal a distance greater than the other front extension portion, and is provided with an inner surface which is adapted to be secured to the outer surface of the other front extension portion, and is provided with an outer marginal edge which terminates along the front marginal edge of the opposite side panel. One of the rear extension portions is constructed in a similar manner. Such a construction provides a substantially free uninterrupted planar surface for printing purposes, protects the associated fin seal which is covered by the extension portion, and increases the rigidity of the associated panel.

Further, the top panel is provided with a front extension portion which cooperates with an upper extension portion of the front panel to define a front top fin seal. In the preferred embodiment, the front extension portion of the top panel is longer than the upper extension portion from the front panel, and the two extension portions are folded downwardly and secured against the front panel to protect the front top fin seal. A rear top fin seal can be produced in a similar manner by a rear extension portion of the top panel and an upper extension portion of the rear panel.

The bottom panel of the package is formed by cooperating bottom extension portions of the first and second side panels and the front and rear panels. In the preferred embodiment of the invention, the bottom extension portions of the first and second side panels are folded inwardly and sealingly secured to one another to define a bottom panel having an intermediate bottom fin seal. The bottom panel is provided with front and rear extension portions which are sealingly secured to the bottom extension portions of the front and rear panels to produce bottom front and rear edge fin seals respectively. Further, the front and rear bottom extension portions are adapted to extend from their respective fin seals a distance longer than the respective bottom panel extension portions, and are folded against and secured to the bottom panel to protect both the bottom front and rear edge fin seals and the intermediate bottom fin seals.

The preferred embodiment of the package is further provided with a unique tear away opening feature. In particular, the front extension portion of the top panel which cooperates with the upper extension portion of the front panel to produce the top front fin seal functions as an opening tab, and includes concealed tear line segments operatively connected to spaced apart tear line segments provided in the top panel. Each tear line segment originates at a front corner of the top panel and terminates at an adjacent rear corner of the top panel. Between the two corners, the tear line portion is spaced from the outer side marginal edges of the top panel. Thus, when the opening tab is lifted to break the associated tear lines, a pair of spaced apart ear portions remain hingedly attached to the first and second side panels, but can be easily deflected outwardly to remove the contents of the package. Thus, in the preferred embodiment of the invention, the only exposed tear lines are located in the top panel of the package, and are not located along the upper edges of the panel.

Other features, and advantages of the present invention will be apparent to one skilled in the art from the following detailed description of the invention in conjunction with the attached drawings.

DETAILED DESCRIPTION OF THE PREFERRED EMBODIMENT

Preliminarily, it should be noted that various laminated materials are commercially available, and may be used for fabricating a package of the present invention. Such laminated materials include multiple layers, of which the center most is typically one or two layers of paper or paperboard which is, covered on both sides by a thermoplastic material such as, for example, polyethylene. In instances wherein it is desirable to provide light blocking or acid resistance, an aluminum foil layer is added, and an additional layer of plastic is used to bond it to the paper. The outermost plastic layers may be formed of one, two, or more separate plastic coatings. Since these laminated materials are well known and commercially available, the individual layers will not be further discussed. Laminated materials suitable for producing the package of the present invention are available from International Paper Company of New York, N.Y. It will be appreciated that other types of flexible sheet packaging material other than paperboard can be used to construct the package of the present invention.

Also, such laminated materials are often provided with apertures extending through some, but not all, of the laminated layers to provide a weakened area for insertion of a drinking straw. It will be appreciated that the illustrated embodiment of the invention may be fabricated out of such a material, if a straw opening is desired.

It should specifically be noted that terms such as "front", "back", "side", "top" and "bottom" are used herein to facilitate the description of the preferred embodiment of the invention, and are not intended as a limitation on the position the package may be in at any stage of its fabrication or handling, either before or subsequently to being filled with a product. Also, such terms should not be considered as a limitation regarding the possibility of modifications such as mirror-image fabrication of the package.

Figure 1:
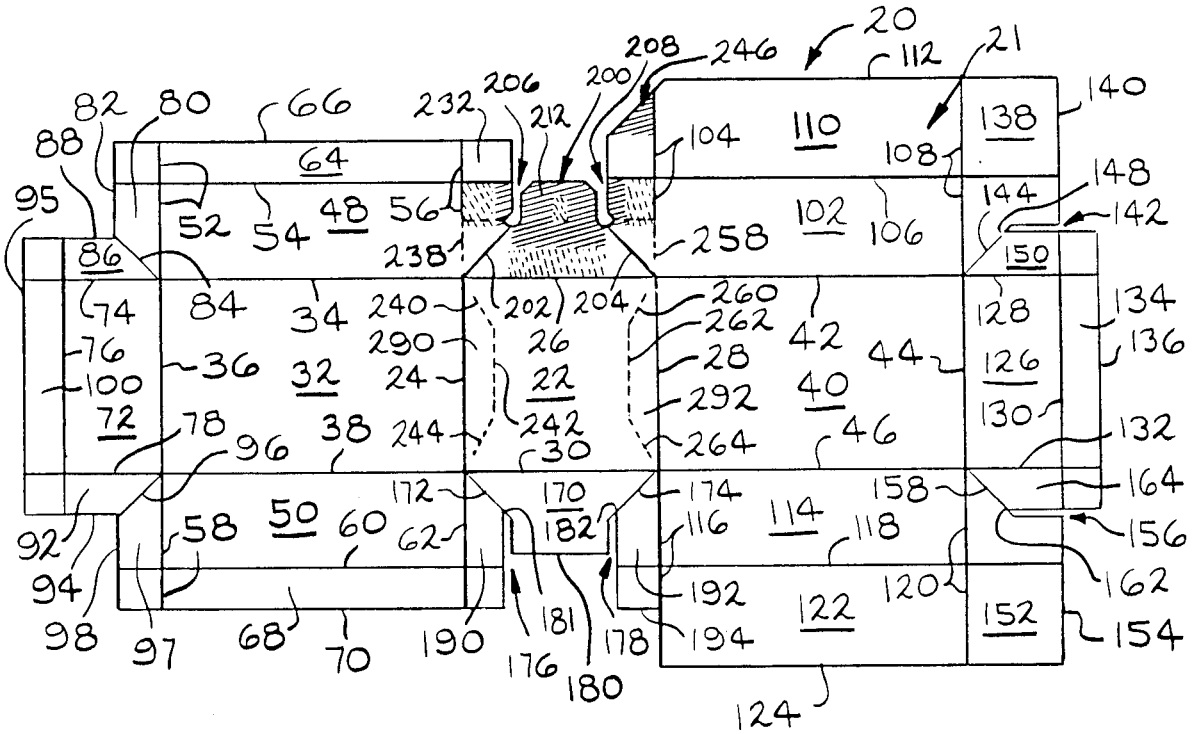
FIG. 1 is a plan view of an inner or first side of a sheet of paperboard material which has been precut and prescored and is suitable for fabricating a package according to the preferred embodiment of the invention.
Figure 2:
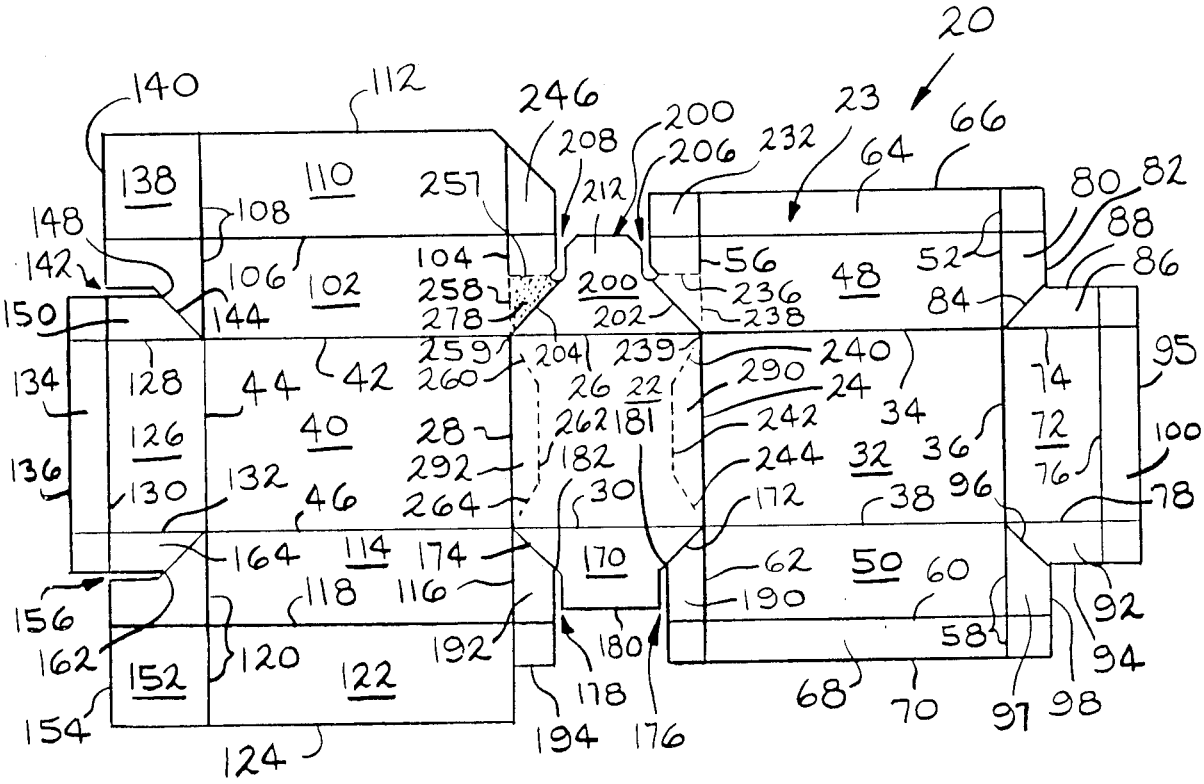
FIG. 2 is a plan view, similar to FIG. 1, but showing the outer or second side of the sheet illustrated in FIG. 1.

Prior to discussing the completed package of the present invention (shown in FIGS. 10 and 11), and the manner in which it is constructed (shown in FIGS. 4 through 9), the various panel sections and fold lines of the blank from which the package is formed will be discussed. Turning now to FIGS. 1 and 2, there is shown a sheet 20 formed of a suitable laminated material which is coated on both sides with a heat activated bonding and sealing material, such as a thermoplastic film. If desired, cold or pressure bonding coatings or adhesives may also be used. The bonding and sealing material can either cover both sides of the entire sheet, or only certain portions, as will become apparent from the description which follows.

In FIGS. 1 and 2, the sheet 20 has been precut into a predetermined configuration as shown, and is provided with a plurality of fold lines which are illustrated in the drawings as solid lines within the outer periphery of the sheet. The fold lines define locations along which the sheet is either temporarily or permanently folded during the construction of the package. The fold lines can be formed by a conventional scoring or embossing operation.

Also, the sheet can include weakened or perforated tear lines (shown as dashed lines) which, as will be discussed, define the portion of the sealed package to be subsequently opened. Typically, in instances wherein the package must provide a fluid-tight barrier, the tear lines are formed during the lamination operation of the sheet 20. For example, the inner paper layer(s) of the laminated material can be perforated prior to the application of the inner and outer layers of the thermoplastic film. In instances wherein it is not necessary to provide a fluid-tight seal, the perforated tear lines can be formed after the lamination operation is completed.

The sheet 20 has an inner or first side 21 (shown in FIG. 1) and an outer or second side 23 (shown in FIG. 2). The sheet 20 includes a top panel 22 bounded by fold lines 24, 26, 28, and 30. A first side panel 32 is connected to the top panel 22 along the fold line 24, and is further bounded by fold lines 34, 36, and 38. A second side panel 40 is connected to the top panel 22 along the fold line 28, and is further bounded by fold lines 42, 44, and 46.

A first front panel portion 48 and a first rear panel portion 50 are disposed on opposite sides of the first side panel 32 and are extensions thereof. The first front panel portion 48 is connected to the side panel 32 along the fold line 34, and is further defined by fold lines 52, 54, and 56. Correspondingly, the first rear panel portion 50 is connected to the side panel 32 along the fold line 38, and is further defined by fold lines 58, 60, and 62.

The first front panel portion 48 has a first front seal area 64 extending therefrom and connected thereto along the fold line 54, and further defined by a peripheral edge portion 66 of the sheet 20. Similarly, the first rear panel portion 50 has first rear seal area 68 extending therefrom and connected thereto, and defined between the fold line 60 and a peripheral edge portion 70 of the sheet 20. A first bottom panel portion 72 is an extension of and is connected to the side panel 32 along the fold line 36, and is further defined by fold lines 74, 76, and 78.

A first bottom edge seal area 80 is an extension of and is connected to the front panel portion 48 along the fold line 52, and is further defined by the fold line 54, a peripheral edge portion 82 perpendicular to the edge portion 66, and a diagonal fold line 84. Adjacent the first bottom edge seal area 80 is a second bottom edge seal area 86 which is an extension of the first bottom panel portion 72, and is defined between the fold line 74, the diagonal fold line 84, a peripheral edge portion 88 perpendicular to the edge portion 82, and the fold line 76.

Corresponding to the second bottom edge seal area 86 there is a third bottom edge seal area 92 which is also an extension of the first bottom panel portion 72. The seal area 92 is defined between the fold line 78, the fold line 76, a peripheral edge portion 94 which is perpendicular to an end edge portion 95, and a diagonal fold line 96. Corresponding to the first bottom edge seal area 80, there is a fourth bottom edge seal area 97 which is an extension of the first rear panel portion 50, and is defined between the fold line 58, the diagonal fold line 96, a peripheral edge portion 98 perpendicular to the edge portion 94, and the fold line 60. A first bottom seal strip 100 is an extension of the first bottom panel portion 72 and is defined between the fold line 76 and the edge portion 95.

A second front panel portion 102 is an extension of and is connected to the second side panel 40 along the fold line 42, and is further defined by fold lines 104, 106, and 108. A front seal cover 110 is an extension of and is connected to the second front panel portion 102 along the fold line 106, and is further defined by a the fold lines 104 and 108 and a peripheral edge portion 112 of the sheet 20. In accordance with the present invention, the front seal cover 110 extends from the fold line 106 a distance greater than the front seal area 64 extends from the fold line 54.

Corresponding to the second front panel portion 102, a second rear panel portion 114 is an extension of and is connected to the first side panel 40 along the fold line 46, and is further defined by fold lines 116, 118, and 120. Likewise, a rear seal cover 122 is an extension of and is connected to the second rear panel portion 114 along the fold line 118, and is further defined by a peripheral edge portion 124, the fold line 116, and the fold line 120. The rear seal cover 122 extends from the fold line 118 a distance greater than the rear seal area 68 extends from the fold line 60.

A second bottom panel portion 126 is an extension of and is connected to the second side panel 40 along the fold line 44 and is further bounded by fold lines 128, 130, and 132. A second bottom seal strip 134, corresponding to the first bottom seal strip 100, is an extension of the second bottom panel portion 126 and is disposed between the fold line 130 and a peripheral edge portion 136 of the sheet 20.

A first bottom seal cover 138 is an extension of the front seal cover 110 and the second front panel portion 102 and is connected thereto along the fold line 108. The cover 138 is further defined by the edge portion 112, a peripheral edge portion 140 perpendicular to the edge portion 112, a first slot 142 extending perpendicular to the edge portion 140 towards the fold line 108, and a diagonal fold line 144 extending from an end of the first slot 142 to the intersection of the fold lines 42 and 44. As may be seen, the inner end of the first slot 142 defines a stress-concentrating point 148 which is aligned with the fold line 144, and functions to improve the folding characteristics of the sheet along the fold line 144 and insure a smooth fold.

A fifth bottom edge seal area 150 is an extension of and is connected to the second bottom seal panel portion 126 along the fold line 128, and is further defined by the diagonal fold line 144, the first slot 142, and the fold line 130.

A second bottom seal cover 152, corresponding to the first bottom seal cover 138, is an extension of the second rear panel portion 114 and the rear seal cover 122 and is connected thereto along the fold line 120, and is further defined between the edge portion 124, a peripheral edge portion 154 perpendicular to the edge portion 124, a second slot 156 extending perpendicular to the edge portion 154 towards the fold line 120, and a diagonal fold line 158 extending from an end of the second slot 156 to the intersection of the fold lines 44 and 46. As was the case with the first slot 142, the second slot 156 defines stress-concentrating point 162 which insures smooth folding along the diagonal fold line 158.

Corresponding to the fifth bottom edge seal area 150, a sixth bottom edge seal area 164 is an extension of and is connected to the second bottom panel portion 126 along the fold line 132, and is further defined by the diagonal fold line 158, the second slot 156, and the fold line 130.

A rear seal tab 170 is an extension of and is connected adjacent the top panel 22 along the fold line 30, and is further defined by diagonal fold lines 172 and 174, spaced apart and parallel first and second rear slots 176 and 178, and a peripheral edge portion 180. Similar to the construction of the bottom slots 142 and 156, the rear slots 176 and 178 define stress-concentrating points 181 and 182 which insure smooth folding along the diagonal fold lines 172 and 174 respectively.

Adjacent the rear seal tab 170 and on opposite sides thereof are rear edge seal areas 190 and 192. The one edge seal area 190 is an extension of the first rear panel portion 50 and the rear seal area 68, and is defined by the fold line 62, the diagonal fold line 172, the first rear slot 176, and the edge portion 70. The other edge seal area 192 is an extension of the second rear panel portion 114 and the rear seal cover 122, and is defined by the fold line 116, the diagonal fold line 174, the second rear slot 178, and a peripheral edge portion 194 which is shown collinear with the edge portion 70 of sheet 20.

Figure 3:
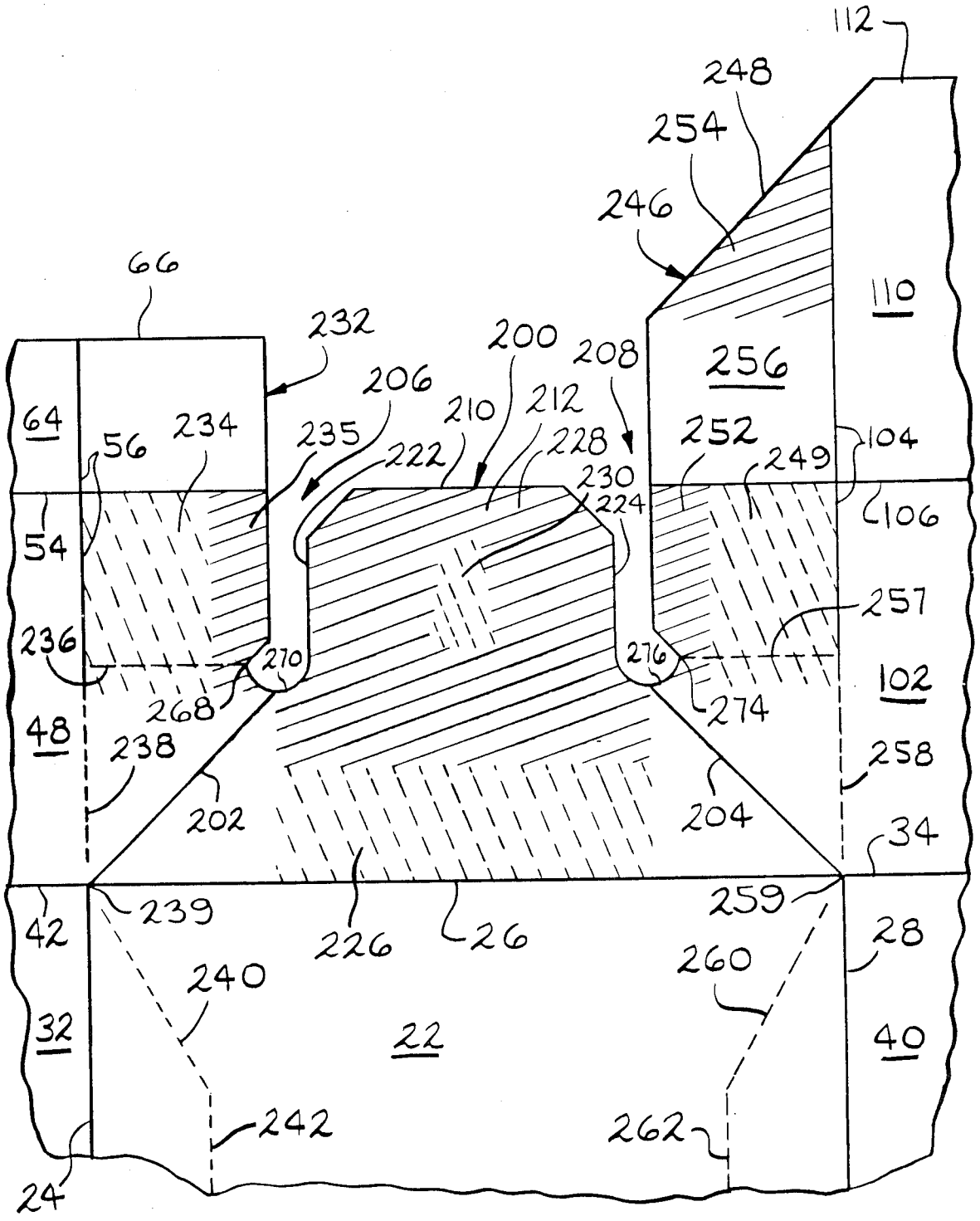
FIG. 3 is an enlarged fragmentary plan view of the portion of FIG. 1 which becomes the opening pull tab area upon assembly of the package according to the preferred embodiment of the invention.

In the preferred embodiment of the invention, a front opening tab 200 is an extension of and is connected to the top panel 22 along the fold line 26. The inner surface of the opening tab 200 and the adjacent areas of the sheet 20 are shown more clearly in the enlarged view of FIG. 3. As shown in FIG. 3, the opening tab 200 is further defined by diagonal fold lines 202 and 204, first and second front slots 206 and 208, and a peripheral edge portion 210. The front opening tab 200 includes a grasping portion 212 defined by the peripheral edge portion 210 and side edge portions 222 and 224. As will be appreciated, the grasping portion 212 can be of any convenient length.

In order to ensure that the final sealed package will open easily, it has been found desirable to apply both a releasable adhesive in certain areas and an unbondable or abhesive coating on certain other areas of the opening tab 200 and the surrounding region. In the drawings, the solid line cross-hatched areas represent those areas to which an abhesive or non-bondable coating is applied, while the dashed line cross-hatched areas represent those areas to which a releasable adhesive is applied. The releasable adhesive provides a means for effectively sealing certain areas of the package, and enables those areas to be subsequently opened with less force than would be required if the releasable adhesive were not used. The abhesive coating prevents any bonding to those areas to which it is applied.

It will be appreciated that the embodiment shown in FIG. 3 is only a preferred embodiment of the invention when the package is to include an easy open feature. For example, it has been found that, in some instances, satisfactory results can be achieved without utilizing any releasable adhesive. Also, as will be discussed with respect to the embodiment of the invention shown in FIGS. 15 and 16, neither a releasable adhesive or an abhesive coating is utilized.

As illustrated in FIG. 3, the front opening tab 200 includes an area 226 adjacent the fold line 26 coated with a releasable adhesive, a peripheral tip area 228 coated with an unbondable or abhesive coating, and a central tip area 230 coated with a releasable adhesive. As illustrated, the releasable adhesive and unbondable coating areas are applied only to the inner side 21 of sheet 20.

As best illustrated in FIG. 3, the sheet 20 includes a first front edge seal area 232 which is an extension of the first front panel portion 48 and the front seal area 64 and is connected thereto along the fold line 56, and is further defined by the diagonal fold line 202, the first front slot 206, and the edge portion 66. The central portion of the inner surface of the first front edge seal 232 has an area 234 coated with a releasable adhesive. Also, preferably, an area 235 adjacent the area 234 is coated with an abhesive.

A first tear line segment 236 extends through the lower portion of the areas 234 and 235 and joins a second tear line segment 238 running along the fold line 56. The second tear line segment 238 extends toward the fold line 26 and is spaced from a corner 239. A third tear line segment 240 is also spaced from the corner 239 and extends diagonally into the top panel 22. The third tear line segment is connected to a fourth tear line segment 242 spaced from the fold line 28. In the preferred embodiment as shown in the drawings, the tear line segment 242 is parallel to the fold line 28. A fifth tear line segment 244 (shown in FIGS. 1 and 2) is connected to the fourth tear line segment 242 and extends diagonally and is slightly spaced from the intersection of the fold lines 24 and 30.

A second front edge seal area 246 corresponds to the first front edge seal area 232, but is of a slightly different configuration due to the difference in width between the first front seal area 64 and the front seal cover 110. The second front edge seal 246 is an extension of the second front panel portion 102 and the front seal cover 110, and connected thereto along the fold line 104. The seal area 246 is further defined by the second front slot 208, the diagonal fold line 204, and a diagonal peripheral edge portion 248.

As illustrated, in the preferred embodiment of the invention, the second front edge seal area 246 includes an area 249 on its inner surface which is coated with a releasable adhesive, an area 252 adjacent the area 249 coated with a non-bondable coating, and a triangular area 254 located above the areas 249 and 252 and which is coated with a non-bondable coating. This leaves a generally rectangular uncoated area 256 located between the area 254 and the areas 249 and 252.

Corresponding to the first tear line segment 236, a sixth tear line segment 257 extends through the lower portion of the areas 249 and 252, and joins a seventh tear line segment 258 lying along the fold line 104 and spaced from a corner 259. An eighth tear line segment 260 is also spaced from the corner 259 and extends diagonally into top panel 22. The eighth tear line segment 260 is connected to a ninth tear line segment 262 spaced from the fold line 28. In the preferred embodiment, the tear line segment 262 is parallel to the fold line 28. The ninth tear line segment 262 is connected to a tenth tear line segment 264 (see FIG. 1) which extends diagonally and is slightly spaced from the intersection of the fold lines 28 and 30.

As best illustrated in FIG. 3, the root portions of the first and second front slots 206 and 208 are configured to facilitate the manufacture and opening of the preferred embodiment of the invention. The root portion of the first slot 206 is shown as including a stress-concentrating point 268, aligned with the first tear line segment 236 of the package in a manner as will be discussed. Also, the root portion of the first slot 206 includes a rounded bottom portion 270 to facilitate the smooth bending of the sheet along the diagonal fold line 202. In like fashion, the root portion of the second front slot 208 includes a stress-concentrating point 274 aligned with the tear line segment 257 to facilitate opening of the package, and a rounded bottom portion 276 to facilitate the smooth folding of the package along the diagonal fold line 204.

Referring specifically to FIG. 2, it may be seen that the preferred embodiment of the sheet 20 includes an unbonded triangular area 278 on its outer side 23. The area 278 is defined by the tear line segments 257 and 258, second front slot 208, and the diagonal fold line 204. This area 278 is preferably not bonded during manufacture by reduced heating or pressure on this area, but an abhesive coating may also be used.

As may be seen from FIGS. 1 and 2, in the preferred embodiment of the invention, many of the individually-described fold lines and edge portions are collinear before the sheet 20 is folded to fabricate the preferred embodiment of the invention. It may be seen that the fold lines 54 and 106 are collinear, and that the fold lines 74, 34, 26, 42, and 128 are collinear. Also the fold lines 78, 38, 30, 42, and 132 are collinear, and the fold lines 60 and 118 are collinear. The edge portions 70 and 194 are collinear, and the edge portions 82 and 98 are collinear. The fold lines 52, 36, and 58 are collinear, and the fold lines 56, 24 and 62 are collinear. The fold lines 104, 28 and 116 are collinear, the fold lines 108, 44, and 120 are collinear, and the edge portions 140 and 154 are collinear. In the preferred embodiment of the invention, the spacing between the fold lines 34 and 54 and between the fold lines 38 and 60 are identical, and equal to one half the length of the fold lines 26 and 30. Also, this spacing is typically equal the spacing between the fold line 106 and the edge portion 112 and between the fold line 118 and the edge portion 124.

Figure 8:
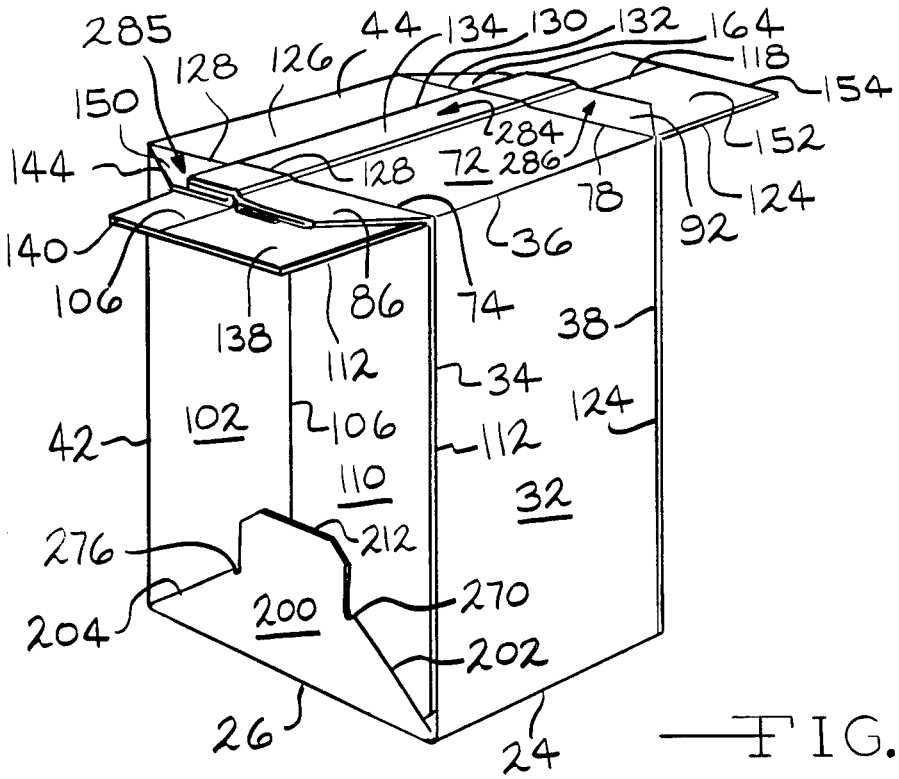
FIG. 8 is a bottom perspective view which illustrates a fifth step in the assembly of a package according to the invention, with the intermediate bottom fin seal of FIG. 7 folded flat.
Figure 9:
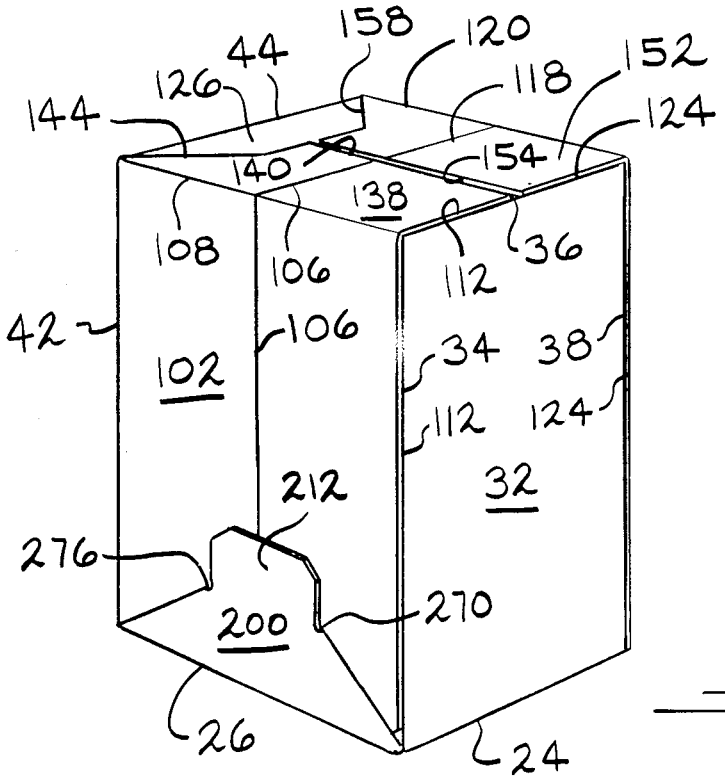
FIG. 9 is a bottom perspective view which shows a completed package according to the invention, with the bottom fin seals covered and protected by the bottom extensions of the side panels.
Figure 10:
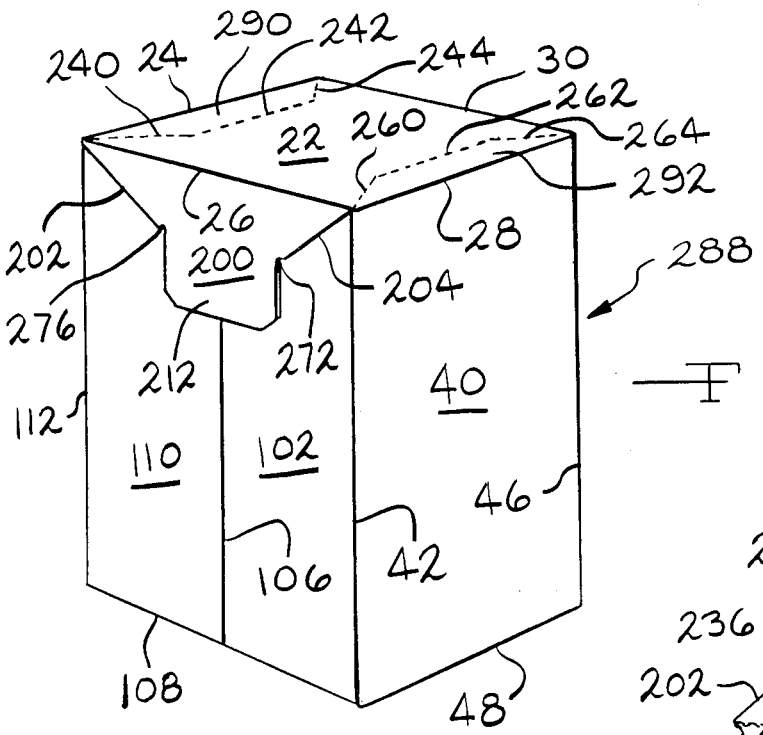
FIG. 10 is a top perspective view which shows a package according to the preferred embodiment of the invention in upright position.

Referring now to FIGS. 4 through 9, one method of folding the sheet of FIGS. 1 and 2 to produce the package as illustrated in FIG. 10 will now be discussed. As will be apparent, other methods of folding and assembling the sheet into the package as described herein can be utilized.

Figure 4:
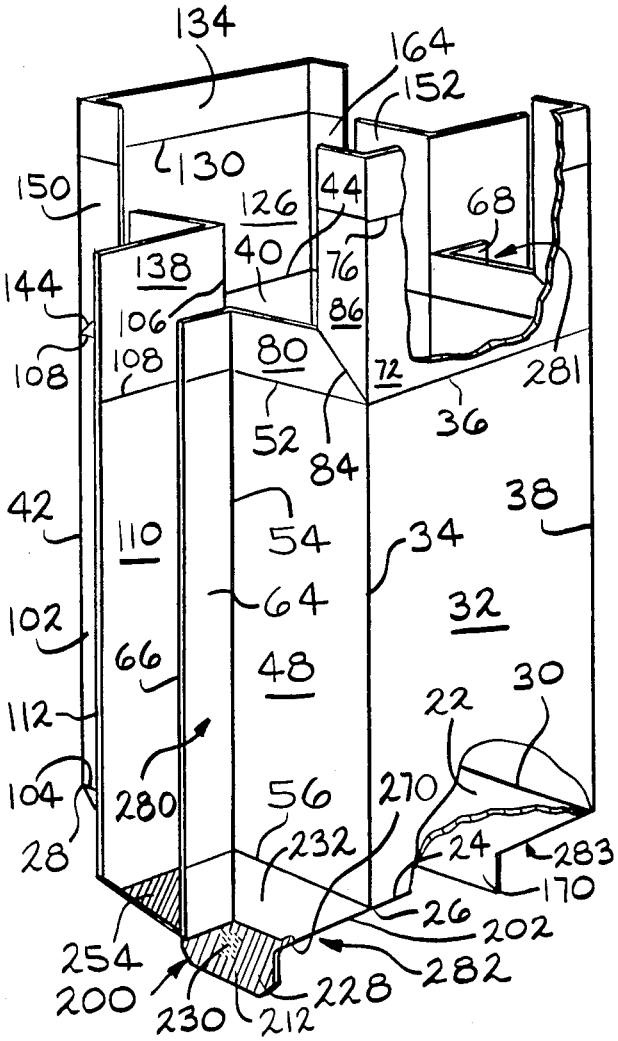
FIG. 4 is a perspective view, with portions broken away, which illustrates a first step in fabrication of a package according to the invention, and which is inverted from its normal position, and wherein extension portions of the side panels are sealed together to form front and rear panels having vertically extending front and rear fin seals, and extension portions of the top panel and front and rear panels are sealed to form front top and rear top fin seals.
Figure 7:
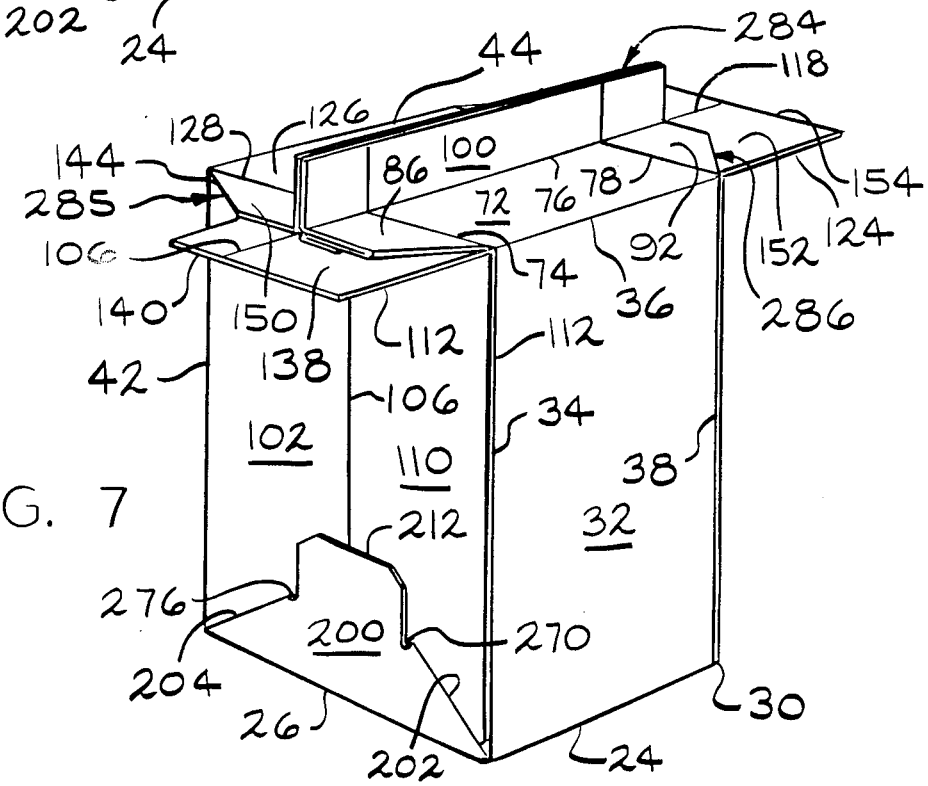
FIG. 7 is a bottom perspective view which shows a fourth step in the assembly of the package of the preferred embodiment of the invention, with bottom extension portions of the first and second side panels sealed together to form a bottom panel with an intermediate bottom fin seal, and extension portions of the bottom panel and the front and rear panels are sealed to form front and rear bottom edge seals.

In viewing FIGS. 4 though 9, it will be appreciated that the partially assembled containers are inverted from their normally used position, i.e., the top panel 22 faces downwardly, and the bottom portion of the package faces upwardly and remains open until the package is filled with a product and the bottom is closed in a manner as shown in FIGS. 7 through 9.

Also, when discussing certain folding and sealing operations, since only a single perspective view is provided to illustrate each operation, not all panel sections or fold lines will be visible.

Referring now to FIG. 4, initially the sheet 20 is positioned such that its inner surface 21 faces upwardly as shown in FIG. 1. Next, the first side panel 32 and the portions attached thereto are folded upwardly along the fold line 24, while the second side panel 40 and its associated attached sections are folded upwardly along the fold line 28, thus produce a generally U-shaped channel member. Next, the first front panel portion 48 is folded inwardly along the fold line 34, while the second front panel portion 102 is also folded inwardly along the fold line 42. As the first and second front panel portions 48 and 102 are folded inwardly, the front edge seal area 64 is folded outwardly along the fold line 54, and the front seal cover 110 is folded outwardly along the fold line 106. Thus, when the first and second front panel portions 48 and 102 have been folded towards one another and are in planar relationship with one another, the inner surface of the front edge seal area 64 contacts the inner surface of the front seal cover 110, as shown in FIG. 4. The contacting portions of the seal area 64 and the cover 110 can then be heated and pressure can be applied to form a front fin seal 280 extending the entire length of the seal area 64. The first rear panel portion 50 and the second rear panel portion 114, along with the rear edge seal area 68 and the rear seal cover 122, are folded and sealed in a similar manner to produce a rear fin seal 281 extending the entire length of the seal area 68.

As the first front panel portion 48 and second front panel portion 102 are folded towards one another in a manner as described above, the opening tab 200 is folded downwardly along the fold line 26. As the opening tab 200 is folded downwardly, the sheet is further folded along the diagonal fold lines 202 and 204 such that the front edge seals 232 and 246 are moved into contact with the inner surface of the opening tab 200. Heat and pressure can then be applied to this area to produce a first top fin seal 282 along the juncture of the fold line 26 and the fold lines 56 and 104. In a similar manner, the rear seal tab 170, and the rear edge seal areas 190 and 192, are folded along the diagonal fold lines 172 and 174, and a second top fin seal 283 is produced along the juncture of the fold line 30 and the fold lines 62 and 116.

Figure 5:
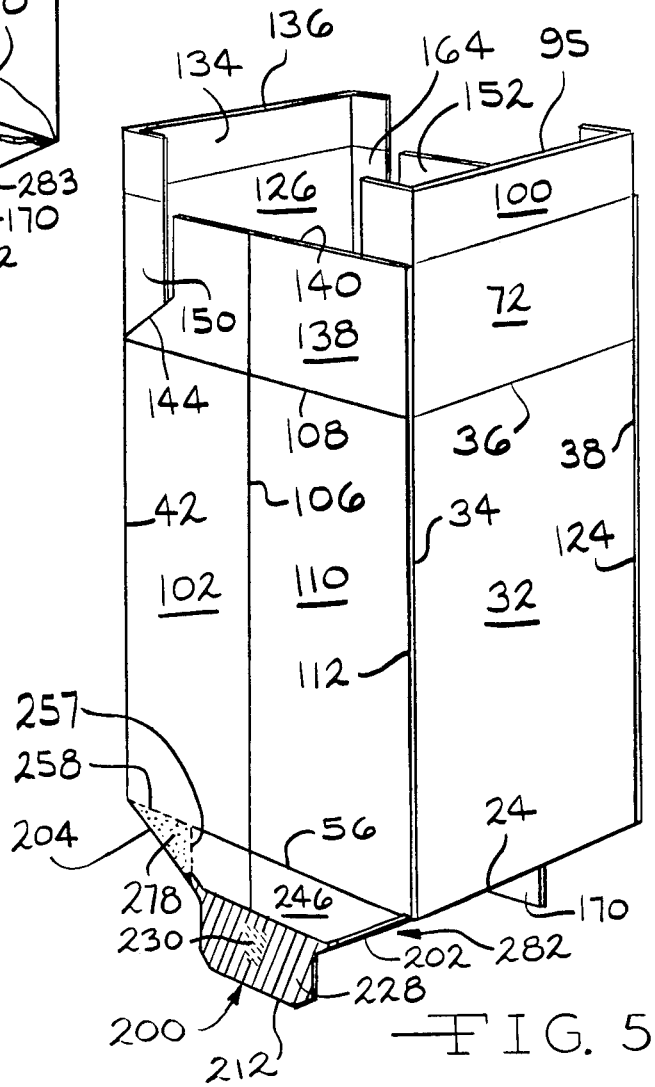
FIG. 5 is a bottom perspective which shows a second step in the assembly of a package according to the invention, in which the side extension portions are folded to cover the front and rear fin seals.

After the sheet has been folded in a manner as shown in FIG. 4 to form the front and rear fin seals 280 and 281 and the first and second top fin seals 282 and 283, the front seal cover 110, together with the front edge seal area 64 which is secured thereto, can be folded towards the first front panel portion 48 along the fold lines 54 and 106. As shown in FIG. 5, the front seal cover 110 is folded until it is substantially planar with the second front panel portion 102, and the inner surface of the front seal cover 110 contacts the outer surface of the first front panel portion 48. At this point, the front panel portion 110 can be secured to the first front seal cover 48. Also, the outer surface of the front edge seal area 64 can be secured to the outer surface of the first front panel portion 48. In a similar manner, the rear seal cover 122 and the rear edge seal area 68 can be folded inwardly and secured to the outer surface of the first rear panel portion 50, and the outer surface of the rear edge seal area 88 can be secured to the outer surface of the first rear panel portion 50.

In addition to providing an effective means for protecting the front and rear fin seals 280 and 281, the front and rear seal covers 110 and 122 have other advantages. For example, as shown in FIG. 5, by extending the front panel portion 110 such that its edge portion 112 terminates along the fold line 34 of the first side panel 32, the front panel of the package is provided with a substantially planar, uninterrupted surface for printing purposes. Similarly, the edge portion 124 of the rear seal cover 122 terminates along the fold line 38. Such a construction produces a very attractive package, and eliminates the need for any accurate registration, which is typically necessary when two printed portions are joined along a common planar surface. Also, it has been found that the front and rear seal covers increase the overall strength of the package by substantially stiffening both the front and rear panels. It has been found that such a construction enables thinner paperboard materials to be used with the present invention, as compared with prior art paperboard containers utilized to package a similar quantity of a similar product.

Figure 6:
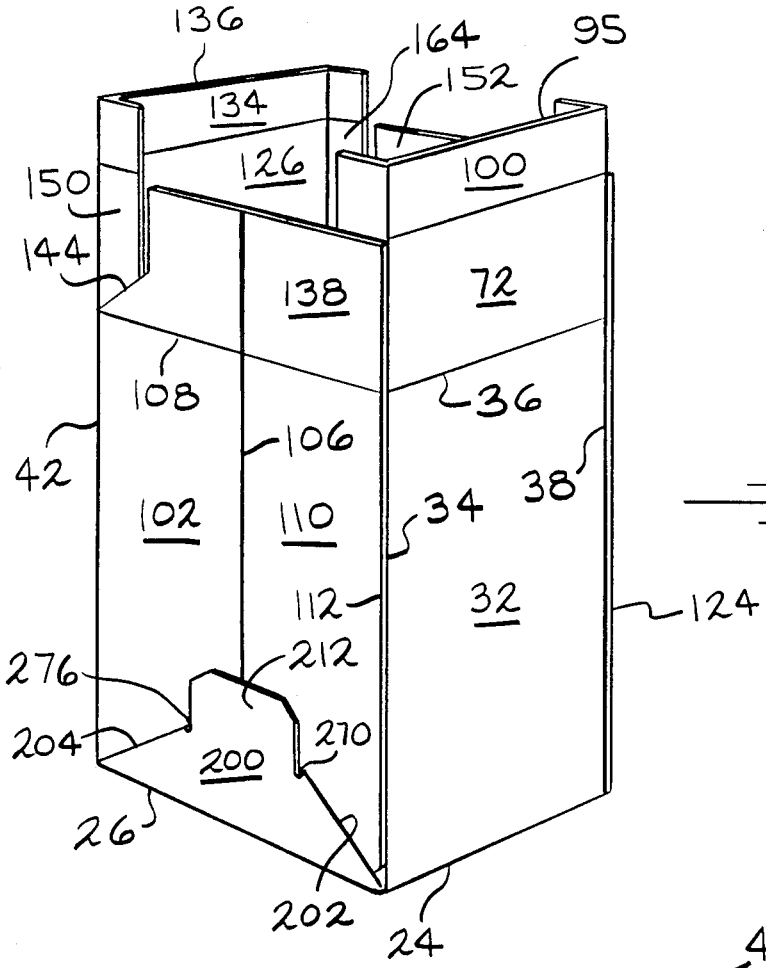
FIG. 6 is a bottom perspective view which shows a third step in the fabrication of a package according to the preferred embodiment of the invention, with the top portion completed, and the bottom portion open for receiving the product to be contained by the package.

Once the front and rear seal covers have been folded inwardly as shown in FIG. 5, the front opening tab 200, which faces downwardly in FIG. 5, is folded upwardly against the front panel, as shown in FIG. 6, and the area 230 to which a releasable adhesive is applied is secured to the front panel. At the same time, the outer surface of the second front edge seal 246, except for the area 278 as discussed above, is heat and pressure sealed to the outer surface of the second front panel portion 102 and the front seal cover 110. It will be appreciated that, during the sealing operation of the first top fin seal 282 and the front opening tab 200, those areas having a releasable adhesive applied thereto will be releasably sealed to the associated contacting surface, while those areas having an abhesive applied thereto will not be sealed to the associated contacting surfaces. For example, the areas 234 and 249 (shown in FIG. 3) will be releasably secured to the area 226, and the areas 235, 228, 252, and 254 will not be secured to the adjacent contacting surface.

In a similar manner, the rear seal tab 170 is folded upwardly, and the outer surface of the rear edge seal 192 and a portion of the rear edge seal 190, along with the exposed inner surface of the tab 170 is secured to the outer surface of the rear panel of the package. It will be appreciated that the front opening tab 200 functions to protect the first top fin seal 282, while the rear seal tab 170 functions to protect the second top fin seal 283.

Once the package has been assembled to the point shown in FIG. 6, the package can be filled with a product. As previously mentioned, the package of the present invention is adapted to be utilized with a wide variety of products. Examples of some types of products which can be packaged include single strength fruit drinks, frozen concentrated fruit drinks, motor oil, and granular or pulverized type material. Further, as will be discussed with reference to FIGS. 15 and 16, the package can also be utilized to package a separate, previously filled container.

After a product has been placed into the container, the bottom seal can be closed in a manner as illustrated in FIGS. 7 through 9. Referring to FIG. 7, initially the first bottom panel portion 72 is folded inwardly along the fold line 36, while the second bottom panel portion 126 is folded inwardly along the fold line 44. As the bottom panel portions 72 and 126 are folded inwardly, the first bottom edge seal strip 100 is folded upwardly along the fold line 76, while the second bottom edge seal strip 134 is folded upwardly along the fold line 130. Thus, when the first and second bottom panel portions 72 and 126 have been folded to the position shown in FIG. 7, the bottom seal edge strips 100 and 134 will extend upwardly and have inner surfaces contacting each other. The inner surfaces can then be heat sealed together to form an intermediate bottom fin seal 284 extending the entire length of the strips 100 and 134.

As the bottom panel portions 72 and 76 are folded inwardly toward one another, the first bottom seal cover 138 is folded outwardly along the fold line 108 such that, when the package is in the position shown in FIG. 7, the inner surfaces of the bottom edge seal area 150 contacts the portion of the inner surface of the first bottom seal cover 138 which is adjacent the fold line 108. Also, in FIG. 7, the inner surface of the bottom edge seal area 86 contacts the inner surface of seal area 80, and the outer surface of seal area 80 contacts the outer end surface of the front seal area 64 and the inner surface of the first bottom seal cover 138. These contacting surfaces can then be sealed to form a first bottom edge fin seal 285 along the juncture of the fold lines 128 and 108 and along the juncture of the fold lines 74 and 52. In a similar manner, the second bottom cover 152 is then folded outwardly and has an inner surface portion sealed to inner surfaces of the bottom edge seal areas 92 and 164 to produce a second bottom edge fin seal 286 along the juncture of the fold line 120 and the fold lines 78 and 132.

Next, the first and second bottom edge seal strips 100 and 134, which extend upwardly as shown in FIG. 7, are folded downwardly against the first bottom panel portion 72, and the outer surface of the bottom edge seal strip 100 is secured to the outer surface of the second bottom panel portion 126. Alternatively, the strips 100 and 134 could be folded towards and secured to the first bottom panel portion 72.

Finally, as shown in FIG. 9, the first and second bottom seal covers 138 and 152, along with the respective edge seal areas which have been sealed thereto, are folded upwardly and inwardly towards one another to the position shown in FIG. 9. At this point, the inner surfaces of the bottom seal covers can be secured to the exposed outer surfaces of the first and second bottom panel portions 72 and 126. In FIG. 9, it can be seen that the outer edge portions 140 and 154 of the seal covers 138 and 152 are parallel and nearly in contact with one another, while the edge portions 112 and 124 are collinear and extend along the fold line 36. As was the case with the front and rear seal covers 110 and 122, the first and second bottom seal covers function to protect the bottom edge fin seals 285 and 286 along with the intermediate bottom fin seal 284, and also functions to increase the stiffness of the bottom panel of the package. Further, such a bottom panel construction is relatively attractive as compared with prior art packages.

FIG. 10 shows a resulting package 288 in its normal orientation for display and use. It should be noted that the tear line segments 236, 238, 257, and 258 (shown in FIG. 11) are concealed in FIG. 10 and protected by the opening tab 200. Also, the tear lines formed by tear line segments 240, 242, 244, 260, 262, and 264 located in the top panel 22 are shown spaced from the top edges defined by the fold line 24 and the fold line 28. This is of course advantageous in that it avoids weakening of the edges formed by the fold lines 24 and 28, or possible premature fracture of the tear lines. This is especially important if the package is to contain a liquid material. Such a construction enables the package to be strong enough to withstand the effects of freezing and possible partial thawing and refreezing of food items contained therein, which can cause expansion and contraction of the package. It will be apparent that, although the tear lines are illustrated as located in the package top panel 22, the tear lines may also be formed in the first side panel 32 and the second side panel 40 and can be spaced downwardly from the fold line 24 and the fold line 28 respectively.

Figure 11:
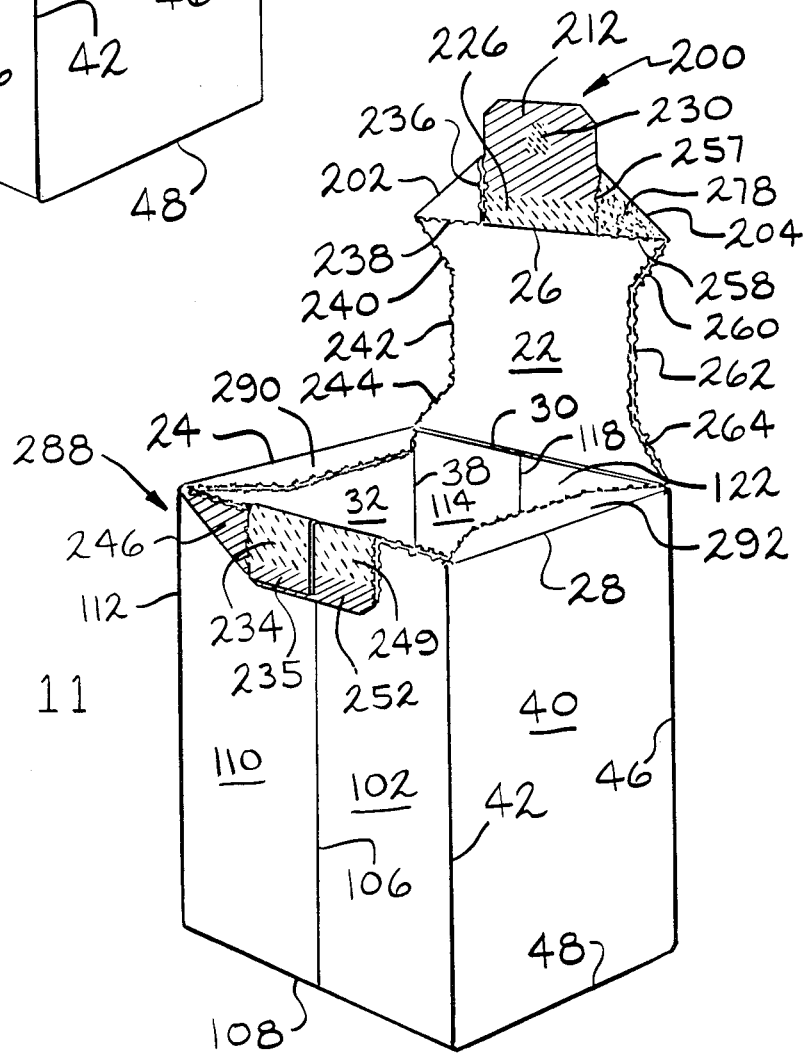
FIG. 11 is a top perspective view which shows the package of FIG. 10 after opening the top panel.

Turning now to FIG. 11, a package of FIG. 10 is shown in an opened configuration, wherein the grasping portion 212 of the opening tab 200 has been lifted upwardly to break the tear line segments 236 and 257 and to release the sealing area 226 from the areas 234 and 249. Continued upward pull on the opening tab will break the tear lines 238 and 258, and thereafter break the remaining tear line segments. At this time, the open package will be as shown in FIG. 11, wherein the central portion of the top panel 22 is hingedly attached to the opening tab 200 along the fold line 26 and is hingedly attached to the rear panel along the fold line 30. When opened in this manner, a first ear portion 290 of the top panel 22 remains hingedly attached to the fold line 24, while a second ear portion 292 remains hingedly attached to the fold line 28. However, since the tear line configuration in the top panel begins and ends at the corners thereof, the ear portions 290 and 292 can easily be deflected upwardly and thus do not interfere with the removal of the contents from the package.

Figure 12:
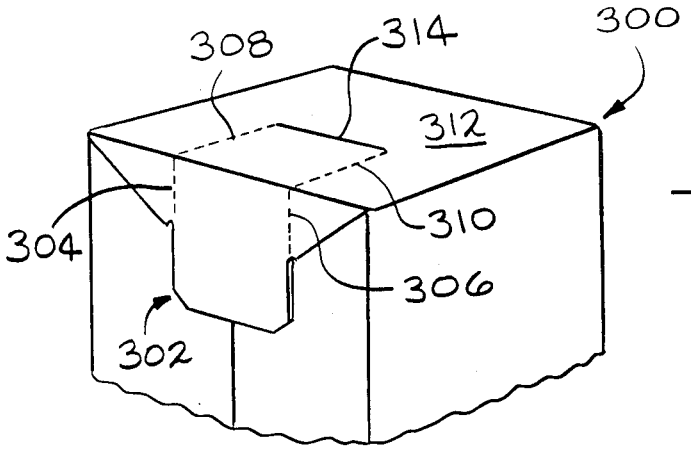
FIG. 12 is a fragmentary perspective illustrating a top portion of an alternate embodiment of the package of the present invention, which includes an alternate opening feature.
Figure 13:
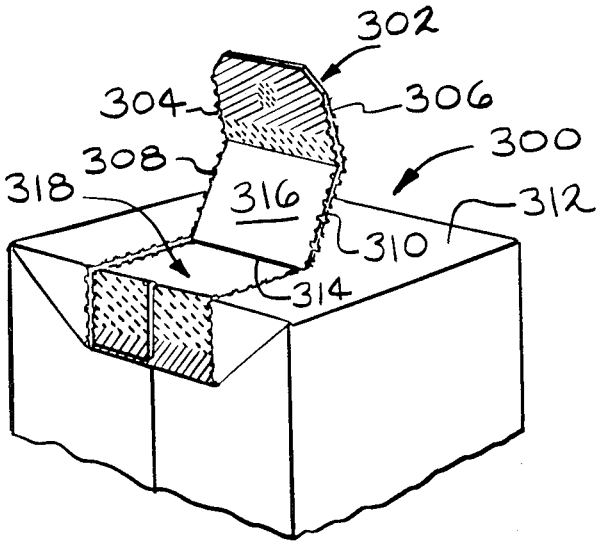
FIG. 13 is a perspective view, similar to FIG. 12, but illustrating the opening tab in its opened position.
Figure 14:
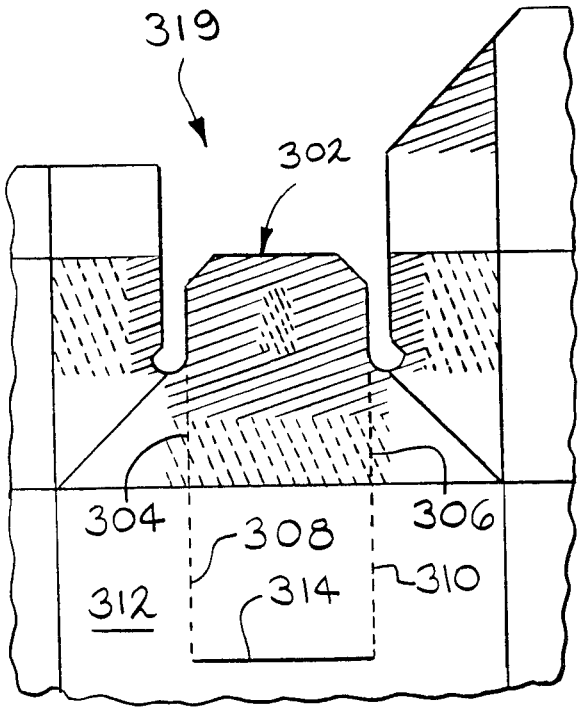
FIG. 14 is a partial plan view illustrating the inside surface of the opening tab portion of a blank which is utilized to construct the package shown in FIGS. 12 and 13.

Referring to FIGS. 12, 13, and 14, there is shown an alternate embodiment of a package 300, similar to the package 288 shown in FIG. 10, but provided with an alternate opening feature. In FIG. 12, the package 300 includes an opening tab 302 having spaced apart parallel tear lines 304 and 306 formed therein. The tear lines 304 and 306 are operatively connected to tear lines 308 and 310 located in a top panel 312 of the package 300. The tear lines 308 and 310 extend inwardly and terminate along a fold or hinge line 314. Alternatively, the fold line 314 could be a tear line. As shown in FIG. 13, when the opening tab 302 is pulled upwardly, the tear lines 304, 306, 308, and 310 are broken to lift a section 316 of the top panel 312 upwardly and provide a partial opening 318 in the top panel of the package.

FIG. 14 illustrates a partial plan view of an inner surface of a blank 319 utilized to construct the package shown in FIGS. 12 and 13. The blank 319 is identical to the sheet 20 shown in FIGS. 1 and 2, except for the relocation of the tear line segments to the locations 304, 306, 308, and 310, and the provision of the hinge line 314. Also, in this arrangement, it is not necessary to provide an abhesive coating to either the inner triangular section 254 (shown in FIG. 3) or the outer triangular section 278 (shown in FIG. 2).

Figure 15:
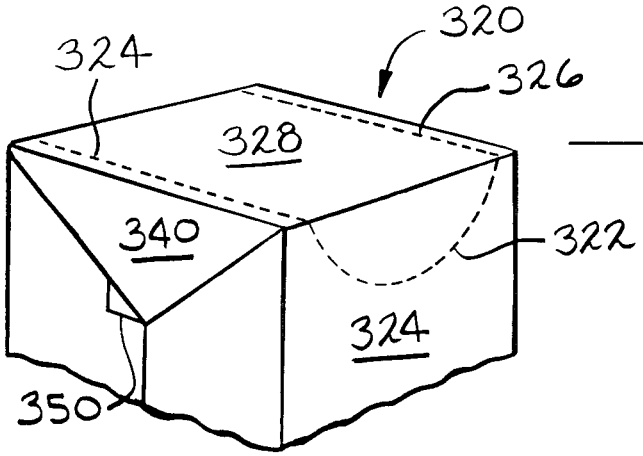
FIG. 15 is a fragmentary top perspective view of an alternate embodiment of a package which includes a further alternate opening feature, and an alternate top sealing structure.

Referring now to FIGS. 15 through 18, there is shown in FIG. 15 a package 320 which includes an alternate top sealing structure and a further alternate opening feature. The package 320 can be used, for example, to package a container which has previously been filled with a product. FIG. 15 illustrates a top portion of the package 320 which is provided with a tear line segment 322 in a side panel 324. The tear line segment 322 can be operatively connected to tear line segments 324 and 326 located in a top panel 328. By depressing the area of the side panel 324 above the tear line 322, the tear line 322 can be broken to enable an upward force to be applied to the top panel to break the tear lines 324 and 326.

Figure 17:
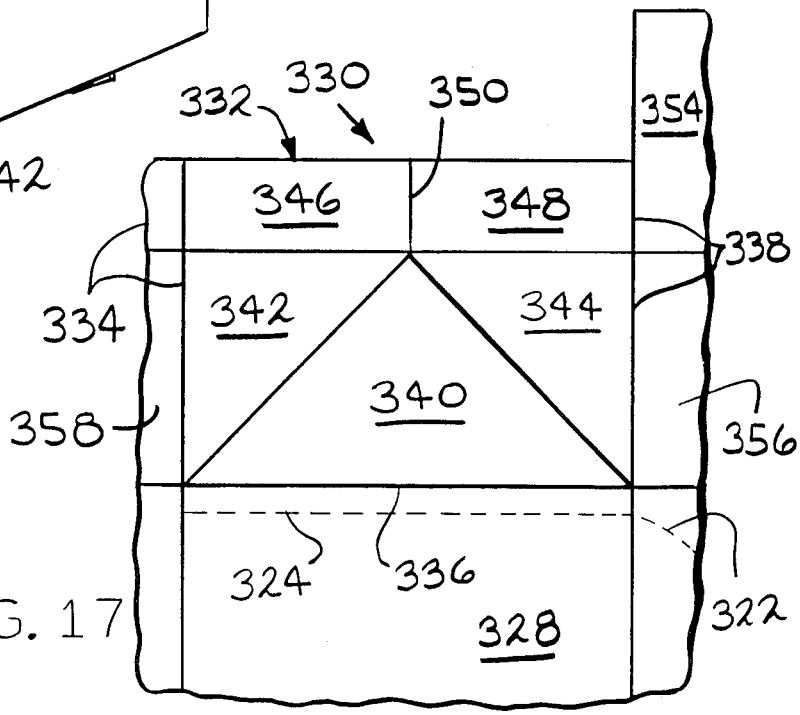
FIG. 17 is a partial plan view illustrating the inside surface of a blank which is utilized to construct the package shown in FIG. 15.

Since an opening tab of the type previously described above with respect to FIGS. 10 through 13 is not necessary with the package 320 of FIG. 15, an alternate top sealing structure can be used. FIG. 17 illustrates a partial plan view of an inner surface of a blank 330 which can be used to produce the package shown in FIG. 15. The blank 330 can be identical to the blank shown in FIGS. 1 and 2 except for a top extension portion 332 bounded by fold lines 334, 336, and 338, which correspond to the fold lines 56, 26, and 104 respectively of FIG. 1. As shown in FIG. 17, the portion 332 includes triangular portions 340, 342, and 344, and rectangular sections 346 and 348. The rectangular sections 346 and 348 are separated by a vertical fold line 350 which, in some instances, may be cut prior to the folding operation to assist in the folding of the package. A rear extension portion of the blank which is located adjacent the rear marginal edge of the top panel 328 can be formed in a similar manner.

Figure 18:
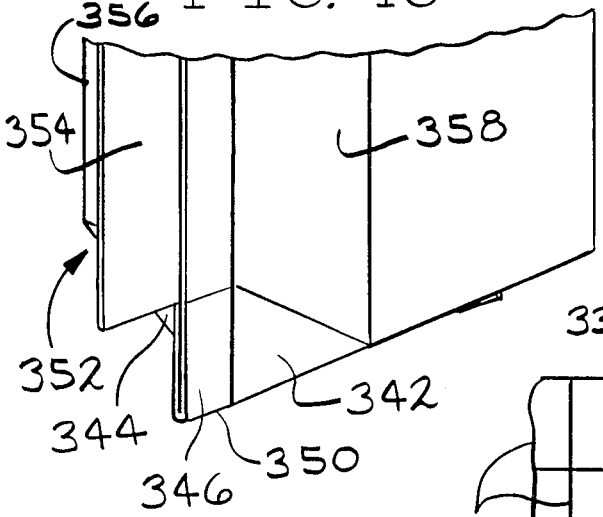
FIG. 18 is a perspective view illustrating the package of FIG. 15 in a partially assembled condition.

FIG. 18 is a perspective view showing a partially assembled package utilizing the blank of FIG. 17. As shown in FIG. 18, a front fin seal 352 is formed which extends vertically downwardly to the bottom fold line 350. A front cover portion 354, which extends from a side panel extension portion 356 can then be folded downwardly against a side panel extension 358. Next, the downwardly extending fold triangular section can be folded upwardly and secured to the outer surface of the front panel of the package.

Figure 16:
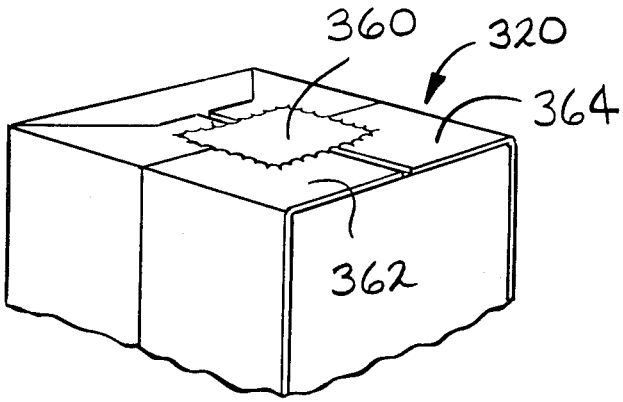
FIG. 16 is partial bottom perspective view of the package of FIG. 15 wherein an auxiliary seal has been provided across the bottom seal covers.

In the configuration of FIGS. 15 and 16, while an opening tab such as the opening tab 200 (shown in FIG. 10) is not necessary, a blank structure similar to FIGS. 1 and 2 can still be utilized. In these instances, the blank which is utilized to form the package shown in FIGS. 15 and 16 can be similar to that of FIGS. 1 and 2, except that it is not necessary to apply either a releasable adhesive or an abhesive to any areas of the blank. Also, the blank is modified to provide the desired tear line configuration.

In instances wherein it is desirable to provide the user of the package with an indication that the package has not been previously opened, it may be desirable to provide the package with auxiliary seals which, if broken, would indicate that the package has previously been opened. For example, as shown in FIG. 16, a bottom auxiliary seal 360 can be connected across bottom seal covers 362 and 364. If a blank as shown in FIGS. 1 and 2 is used, a similar auxiliary seal can also be connected between the front and rear seal tabs (not shown) and the front and rear panels of the package.

While the package of the present invention has been illustrated and described as having a specific unique bottom panel construction, it will be appreciated that other types of known bottom or end panel constructions can be utilized.

Also, while the package is described and claimed herein as being generally rectangular or parallelpiped, it will be appreciated that, in some instances, it may be desirable to attach a handle or spout to the package, either during or subsequent to the construction of the package.

Numerous other modifications and variations of the illustrated preferred embodiments of the invention, and its numerous useful features, will be apparent to one skilled in the art, and may be easily implemented without departing from the spirit and scope of the claimed invention.

What is claimed is:

1. A package comprising:

a generally parallelepiped container including a top panel and a front panel, said top panel having a front marginal edge located adjacent an upper marginal edge of said front panel;

said top panel including a first extension portion extending outwardly from said front marginal edge;

said front panel including a second extension portion extending outwardly from said upper marginal edge;

said first and second extension portions having inner surfaces sealingly connected to define a front seal line at the juncture of said front marginal edge of said top panel and said upper marginal edge of said front panel, said first and second extension portions being folded downwardly against said front panel;

one of said first and second extension portions secured to an outer surface of said front panel.

2. The package according to claim 1 wherein said first extension portion extends from front said seal line a distance longer than said second extension portion.

3. The package according to claim 2 wherein an inner surface of said first extension portion is secured to an outer surface of said front panel.

4. The package according to claim 1 wherein said first and second extension portions cooperate to define an opening tab for opening said container, said opening tab operatively connected to tear line means, said tear line means defining a portion of said container to be opened.

5. The package according to claim 1 wherein said container includes a rear panel having an upper marginal edge located adjacent a rear marginal edge of said top panel, said rear panel being parallel to and spaced from said front panel and said rear marginal edge being parallel to and spaced from said front marginal edge, said top panel including a third extension portion extending outwardly from said rear marginal edge, said rear panel including a fourth extension portion extending outwardly from said upper marginal edge, said third and fourth extension portions having inner surfaces sealingly connected to define a rear seal line at the juncture of said rear marginal edge of said top panel and said upper marginal edge of said rear panel.

6. The package according to claim 5 wherein said first extension portion extends from said front seal line a distance longer than said second extension portion, said first and second portions being folded downwardly against said front panel and said first extension portion having an inner surface secured to an outer surface of said front panel, and wherein said third extension portion extends from said rear seal line a distance longer than said fourth extension portion, said third and fourth extension portions being folded downwardly against said rear panel and said third extension portion having an inner surface secured to an outer surface of said rear panel.

7. The package according to claim 6 wherein said first and second extension portions cooperate to define an opening tab for opening said container, said opening tab operatively connected to tear line means, said tear line means defining a portion of said container to be opened.

8. A package comprising:

a generally parallelepiped container including parallel and spaced apart front and rear panels connecting parallel and spaced apart first and second side panels;

said front panel formed by a first extension portion extending from a front marginal edge of said first side panel and by a second extension portion extending from a front marginal edge of said second side panel;

said first and second extension portions having inner surfaces sealingly connected to form a front seal line located in said front panel;

said first extension portion extending from said front seal line a distance longer than said second extension portion;

said rear panel formed by a third extension portion extending from a rear marginal edge of said first side panel and by a fourth extension portion extending from a rear marginal of said second side panel;

said third and fourth extension portions having inner surfaces sealingly connected to form a rear seal line located in said rear panel; and said third extension portion extending from said rear seal line a distance longer than said fourth extension portion.

9. The package according to claim 8 wherein said first extension portion includes an inner surface portion secured to an outer surface portion of said second extension portion and having a first outer marginal edge terminating adjacent said front marginal of said second side panel and said third extension portion includes an inner surface portion secured to an outer surface portion marginal edge terminating adjacent said rear marginal edge of said second said panel.

10. A package comprising:

a generally parallelepiped container including parallel and spaced apart front and rear panels connecting parallel and spaced apart first and second side panels;

said front panel formed by a first extension portion extending from a front marginal edge of said first side panel and by a second extension portion extending from a front marginal edge of said second side panel;

said first and second extension portions having inner surfaces sealingly connected to form a front seal line located in said front panel;

said first extension portion extending from said front seal line a distance longer than said second extension portion;

said rear panel formed by a third extension portion extending from a rear marginal edge of one of said first and second side panels and by a fourth extension portion extending from a rear marginal of the other one of said first and second side panels;

said third and fourth extension portions having inner surfaces sealingly connected to form a rear seal line located in said rear panel; and said third extension portion extending from said rear seal line a distance longer than said fourth extension portion.

11. The package according to claim 10 wherein said first extension portion includes an inner surface portion secured to an outer surface portion of said second extension portion and having a first outer marginal edge terminating adjacent said front marginal of said second side panel and said third extension portion includes an inner surface portion secured to an outer surface portion of said fourth extension portion and having a second outer marginal edge terminating adjacent said rear marginal edge of said other one of said first and second side panels.

12. The package according to claim 11 wherein said first outer marginal edge extends substantially along the entire length of said front marginal edge of said second side panel, and wherein said second outer marginal edge extends substantially along the entire length of said rear marginal edge of said other one of said first and second side panels.

13. The package according to claim 12 wherein said one of said first and second side panels is said first panel.

14. The package according to claim 12 and further including:

a top panel having spaced apart and parallel front and rear marginal edges connected by spaced apart and parallel first and second side marginal edges, said first side marginal edge of said top panel connecting first and second corners, said second side marginal edge of said top panel connecting third and fourth corners, said front marginal edge of said top panel connecting said first and third corners, and said rear marginal edge of said top panel connecting said second and fourth corners;

said front panel having an upper marginal edge connected to said front marginal edge of said top panel, said rear panel having an upper marginal edge connected to said rear marginal edge of said top panel, said first side panel having an upper marginal edge connected to said first side marginal edge of said top panel, and said second side panel having an upper marginal edge connected to said second side marginal edge of said top panel;

said container further including tear line means having first and second tear lines located in said top panel and a third tear line located along said first side marginal edge of said top panel;

said first tear line extending alongside said front marginal edge of said top panel and originating adjacent said first corner and terminating adjacent said third corner;

said second tear line extending alongside said rear marginal edge of said top panel and originating adjacent said second corner and terminating adjacent said fourth corner;

said third tear line originating adjacent said first corner and terminating adjacent said third corner;

said first, second, and third tear lines cooperating to define a portion of said container to be opened such that, when said first, second, and third tear lines are severed, said openable portion remains hingedly attached along said second side marginal edge of said top panel.

15. The package according to claim 14 wherein said third tear line is located in said first side panel.

16. The package according to claim 14 wherein the portion of said first tear line located between said first and third corners is spaced from said front marginal edge of said top panel, and the portion of said second tear line located between said second and fourth corners is spaced from said rear marginal edge of said top panel, said front marginal edge of said top panel and said first tear line cooperating to define a first ear portion and said rear marginal edge of said top panel and said second tear line cooperating to form a second ear portion such that, after said openable portion is disconnected along said first, second, and third tear lines, enables said first and second ear portions to be hinged upwardly about said front and rear marginal edges, respectively, to provide further access to the contents of the container through the top panel thereof.

17. The package according to claim 16 including an opening tab connected to said openable portion of said container, said opening tab adapted to be grasped by a user of said container and pulled away from said container to cause said container to sever along said first, second, and third tear lines and thereby open said container.

18. The package according to claim 17 wherein said opening tab substantially covers and protects said third tear line.

19. The package according to claim 18 wherein the ends of said first, second, and third tear lines are slightly spaced from the respective adjacent corners.

20. The package according to claim 19 wherein said paperboard is provided with a plastic coating on at least one surface thereof.

21. The package according to claim 20 wherein said first and second tear lines include a predetermined perforation pattern formed in said paperboard, said perforation pattern extending only through said paperboard.

22. A package comprising:

a generally parallelepiped container including parallel and spaced apart front and rear panels connecting parallel and spaced apart first and second side panels;

said front panel being formed by a first extension portion extending from a front marginal edge of said first side panel and by a second extension portion extending from a front marginal edge of said second side panel;

said first and second extension portions having inner surfaces sealingly connected to form a front seal line located in said front panel;

said first and second extension portions having outer portions extending outwardly from said front seal line and being folded against an outer surface of said second extension portion such that said first extension portion is substantially planar and said second extension portion is folded and has outer surface sections secured to one another;

said rear panel being formed by a third extension portion extending from a rear marginal edge of one of said first and second side panels and by a fourth extension portion extending from a rear marginal edge of the other one of said first and second side panels;

said third and fourth extension portions having inner surfaces sealingly connected to form a rear seal line located in said rear panel;

said third and fourth extension portions having inner surfaces sealingly connected to form a rear seal line located in said rear panel;

said third and fourth extension portions having outer portions extending outwardly from said rear seal line and being folded against an outer surface of said fourth extension portion such that said third extension portion is substantially planar and said fourth extension portion is folded and has outer surface sections secured to one another.

23. The package according to claim 12 wherein said first extension portion has a first outer marginal edge terminating adjacent said front marginal edge of said second side panel and said third extension portion has a second outer marginal edge terminating adjacent said rear marginal edge of said other one of said first and second side panels.

24. The package according to claim 23 wherein said first outer marginal edge terminates adjacent to and extends substantially along the entire length of said front marginal edge of said second side panel, and wherein said second outer marginal edge terminates adjacent to and extends substantially along the entire length of said rear marginal edge of said other one of said first and second side panels.

25. The package according to claim 24 wherein said one of said first and second side panels is said first panel.

26. The package according to claim 24 and further including:

a top panel having spaced apart and parallel front and rear marginal edges connected by spaced apart and parallel first and second side marginal edges, said first side marginal edge of said top panel connecting first and second corners, said second side marginal edge of said top panel connecting third and fourth corners, said front marginal edge of said top panel connecting said first and third corners, and said rear marginal edge of said top panel connecting said second and fourth corners;

said front panel having an upper marginal edge connected to said front marginal edge of said top panel, said rear panel having an upper marginal edge connected to said rear marginal edge of said top panel, said first side panel having an upper marginal edge connected to said first side marginal edge of said top panel, and said second side panel having an upper marginal edge connected to said second side marginal edge of said top panel;

said container further including tear line means having first and second tear lines located in said top panel and a third rear line located along said first side marginal edge of said top panel;

said first tear line extending alongside said front marginal edge of said top panel and originating adjacent said first corner and terminating adjacent said third corner;

said second tear line extending alongside said rear marginal edge of said top panel and originating adjacent said second corner and terminating adjacent said fourth corner;

said third tear line originating adjacent said first corner and terminating adjacent said third corner;

said first, second, and third tear lines cooperating to define a portion of said container to be opened such that, when said first, second, and third tear lines are severed, said openable portion remains hingedly attached along said second side marginal edge of said top panel.

27. The package according to claim 26 wherein said third tear line is located in said first side panel.

28. The package according to claim 26 wherein the portion of said first tear line located between said first and third corners is spaced from said front marginal edge of said top panel, and the portion of said second tear line located between said second and fourth corners is spaced from said rear marginal of said top panel, said front marginal edge of said top panel and said first tear line cooperating to define a first ear portion and said rear marginal edge of said top panel and said second tear line cooperating to form a second ear portion such that, after said openable portion is disconnected along said first, second, and third tear lines, enables said first and second ear portions to be hinged upwardly about said front and rear marginal edges, respectively, to provide further access to the contents of the container through the top panel thereof.

29. The package according to claim 28 including an opening tab connected to said openable portion of said container, said opening tab adapted to be grasped by a user of said container and pulled away from said container to cause said container to sever along said first, second and third tear lines and thereby open said container.

30. The package according to claim 29 wherein said opening tab substantially covers and protects said third tear line.

31. The package according to claim 30 wherein the ends of said first, second, and third tear lines are slightly spaced from the respective adjacent corners.

32. The package according to claim 31 wherein said paperboard is provided with a plastic coating on at least one surface thereof.

33. The package according to claim 32 wherein said first and second tear lines include a predetermined perforation pattern formed in said paperboard, said perforation pattern extending only through said paperboard.

34. A package comprising:

a generally parallelepiped container including parallel and spaced apart front and rear panels connecting parallel and spaced apart first and second side panels, and a bottom panel connected to a lower marginal edge of each of said front, rear, and first and second side panels;

said front, rear, and first and second side panels each including an extension portion extending from a lower marginal edge thereof;

said bottom panel being formed in part by folding said first and second side panel extension portions inwardly toward one another, first and second side panel extension portions being sealingly connected together to define a first bottom seal line;

said bottom panel provided with a front extension portion extending from a front marginal edge thereof located adjacent the lower marginal edge of said front panel;

said front panel extension portion and said front extension portion of said bottom panel being sealingly connected to define a second bottom seal line located along the juncture of said front marginal edge of said bottom panel and said lower marginal edge of said front panel.

35. The package according to claim 34 wherein said front panel extension portion extends outwardly from said second bottom seal line a distance longer than said bottom panel front extension portion, and said front panel extension portion and said bottom front panel extension portion are folded inwardly and transversely to said first and second side panel portions against said bottom panel to at least in part cover said first and second side panel extension portions.

36. The package according to claim 34 wherein said front panel extension portion includes an inner surface secured to an outer surface of one of said first and second side panel extension portions.

37. The package according to claim 34 wherein said bottom panel is provided with a rear extension portion extending from a rear marginal edge thereof located adjacent the lower marginal edge of said rear panel, and said rear panel extension portion and said rear extension portion of said bottom panel is sealingly connected to define a third bottom seal line located along the juncture of said rear marginal edge of said bottom panel and said lower marginal edge of said rear panel.

38. The package according to claim 37 wherein said front panel extension portion and said bottom panel front extension portion are folded inwardly and transversely to said first and second side panel portions against said bottom panel to at least in part cover said first and second side panel extension portions, and said rear panel extension portion and said bottom panel rear extension portion are folded inwardly and transversely to said first and second side panel portions against said bottom panel to at least in part cover said first and second side panel extension portions, said front panel extension portion provided with an outer marginal edge generally parallel to and adjacent to an outer marginal edge of said rear panel extension portion, said front and rear panel extension portions provided with collinear side marginal edges located adjacent the junction of said first side panel and said first side panel extension portion.

39. A package comprising;

a generally parallelepiped container including parallel and spaced apart front and rear panels connecting parallel and spaced apart first and second side panels, and a bottom panel connected to a lower marginal edge of each of said front, rear, and first and second side panels;

said front, rear, and first and second side panels each including an extension portion extending from a lower marginal edge thereof;

said bottom panel being formed in part by folding said first and second side panel extension portions inwardly toward one another, said first and second side panel extension portions being sealingly connected together to define a bottom seal line;

said front and rear panel extension portions being folded inwardly and transversely to said first and second side panel extension portions to at least in part cover said first and second side panel extension portions;

at least one of said front and rear panel extension portions having an outer marginal edge located adjacent to and extending generally parallel along the junction of said bottom panel and one of said first and second side panels.

40. A package comprising:

a generally parallelepiped container including parallel and spaced apart front and rear panels connecting parallel and spaced apart first and second side panels, a top panel coupled to the upper ends of said front, rear, and first and second side panels, and a bottom panel coupled to the lower ends of said front, rear and first and second side panels;

said front panel being formed by a first front extension portion extending from a front side marginal edge of said first side panel and by a second front extension portion extending from a front side marginal edge of said second side panel;

said first and second front extension portions having inner surfaces sealingly connected to form a front fin seal located in said front panel;

said rear panel being formed by a first rear extension portion extending from a rear side marginal edge of said first side panel and by a second rear extension portion extending from a rear side marginal edge of said second side panel;

said first and second rear extension portions having inner surfaces sealingly connected to form a rear fin seal located in said rear panel;

said top panel having an outer front marginal edge located adjacent an upper front marginal edge of said front panel;

said top panel including a front top extension portion extending from said outer front marginal edge;

said front panel including an upper extension portion extending from said upper front marginal edge;

said front top extension portion of said top panel and said upper extension portion of said front panel being sealingly connected to define a front top fin seal at the juncture of said outer front marginal edge of said top panel and said upper front marginal edge of said front panel;

said top panel having an outer rear marginal edge located adjacent an upper rear marginal edge of said rear panel;

said top panel including a rear top extension portion extending from said outer rear marginal edge;

said rear panel including an upper rear extension portion extending from said upper rear marginal edge;

said rear top extension portion of said top panel and said upper rear extension portion of said rear panel being sealingly connected to define a rear top fin seal at the juncture of said outer rear marginal edge of said top panel and said upper rear marginal edge of said front panel; and said bottom panel being attached to the lower marginal edges of said front, rear, and first and second side panels.

41. The package according to claim 40 wherein:

said front, rear, and first and second side panels each include a bottom extension portion extending from said lower marginal edge thereof;

said bottom panel being formed in part by folding said first and second side panel bottom extension portions inwardly toward one another;

said first and second side panel bottom extension portions being sealingly connected together to define an intermediate bottom fin seal;

said bottom panel provided with a bottom front extension portion extending from an outer front marginal thereof located adjacent the lower marginal edge of said front panel;

said front panel bottom extension portion and said bottom panel front extension portion being sealingly connected to define a front bottom edge fin seal located along the juncture of said outer front marginal edge of said bottom panel and said lower marginal edge of said front panel;

said bottom panel provided with a bottom rear extension portion extending from an outer rear marginal edge thereof located adjacent the lower marginal edge of said rear panel; and said rear panel bottom extension portion and said bottom panel rear extension portion being sealingly connected to define a rear bottom edge fin seal located along the juncture of said outer rear marginal edge of said bottom panel and said lower marginal edge of said rear panel.

42. The package according to claim 40 wherein said first front extension portion is substantially planar and has an outer marginal edge portion terminating adjacent said front side marginal edge of said second side panel, and said first rear extension portion is substantially planar and has an outer marginal edge portion terminating adjacent said rear side marginal edge of said second side panel.

43. The package according to claim 40 wherein said front top extension portion of said top panel and upper extension portion of said front panel cooperate to define an opening tab for opening said container, said opening tab operatively connected to tear line means, said tear line means defining a portion of said container to be opened.

44. The package according to claim 43 wherein said top panel has a generally rectangular shape and includes first and second corners connected by an outer marginal edge thereof which connects said top panel to one of said first and second side panels, said tear line means being located in said top panel and defining a portion of said top panel to be opened, said tear line means including a tear line located in said top panel, said tear line originating adjacent said first corner and terminating adjacent said second corner, the portion of said tear line located between said first and second corners being spaced from said outer marginal edge.

45. A blank of flexible packaging sheet material for constructing a container comprising:

a rectangular top panel defining first and second spaced apart and a parallel side marginal edges connecting spaced apart and parallel front and rear marginal edges;

a rectangular first side panel defining spaced apart and parallel front and rear marginal edges connected by spaced apart and parallel upper and lower marginal edges, said upper marginal edge of said first side panel foldably connected to said first side marginal edge of said top panel;

a rectangular second side panel defining spaced apart and parallel front and rear marginal edges connected by spaced apart and parallel upper and lower marginal edges, said upper marginal edge of said second side panel foldably connected to said second side marginal edge of said top panel;

a first front panel portion foldably connected to said front marginal edge parallel to and spaced from said front marginal edge of said first side panel by a first predetermined distance;

a second front panel portion foldably connected to said front marginal edge of said second side panel and having a second outer marginal edge parallel to and spaced from said front marginal edge of said second side panel by a second predetermined distance greater than said first predetermined distance;

a first rear panel portion foldably connected to said rear marginal edge of one of said first and second side panels;

a second rear panel portion foldably connected to said rear marginal edge of the other one of said first and second side panels;

a first bottom portion foldably connected to said lower marginal edge of said first side panel;

a second bottom panel portion foldably connected to said lower marginal edge of said second side panel;

a front panel extension portion foldably connected to said front marginal edge of said top panel; and a rear top panel extension portion foldably connected to said rear marginal edge of said top panel.

46. The blank according to claim 45 wherein said first rear panel portion has a third outer marginal edge parallel to and spaced from said rear marginal edge of said one of said first an second side panels by said first predetermined distance, and said second rear panel portion has a fourth outer marginal edge parallel to and spaced from said rear marginal edge of said other one of said first and second side panels by said second predetermined distance.

47. The blank according to claim 46 wherein said front top extension portion has a fifth outer marginal edge parallel to and spaced from said front marginal edge of said top panel by less than said first predetermined distance, and said rear top panel extension portion has a sixth outer marginal edge parallel to and spaced from said rear marginal edge of said top panel by less than said first predetermined distance.

48. The blank according to claim 46 wherein said second predetermined distance is substantially equal to the length of said front marginal edge of said top panel.

49. The blank according to claim 48 wherein said front top extension portion has a fifth outer marginal edge parallel to and spaced from said front marginal edge of said top panel by said first predetermined distance, and said rear top panel extension portion has a sixth outer marginal edge parallel to and spaced from said rear marginal edge of said top panel by said first predetermined distance.

50. The blank according to claim 49 wherein:

said first side marginal edge of said top panel connects first and second corners, said second side marginal edge of said top panel connects third and fourth corners, said front marginal edge of said top panel connects said first and third corners, and said rear marginal edge of said top panel connects said second and fourth corners;

said container further including tear line means having first and second tear lines located in said top panel and a third tear line located along said first side marginal edge of said top panel;

said first tear line extending alongside said front marginal edge of said top panel and originating adjacent said first corner and terminating adjacent said third corner;

said second tear line extending alongside said rear marginal edge of said top panel and originating adjacent said second corner and terminating adjacent said fourth corner;

said third tear line originating adjacent said first corner and terminating adjacent said third corner.

51. The package according to claim 50 wherein said third tear line is located in said first side panel.

52. The blank according to claim 50 wherein the portion of said first tear line located between said first and third corners is spaced from said front marginal edge of said top panel, and the portion of said second tear line located between said second and fourth corners is spaced from said rear marginal edge of said top panel, said front marginal edge of said top panel and said first tear line cooperating to define a first ear portion and said rear marginal edge of said top panel and said second tear line cooperating to form a second ear portion.

53. The blank according to claim 52 wherein the ends of said first, second, and third tear lines are slightly spaced from the respective adjacent corners.

54. The blank according to claim 53 wherein said paperboard is provided with a plastic coating on at least one surface thereof.

55. The blank according to claim 54 wherein said first and second tear lines include a predetermined perforation pattern formed in said paperboard, said perforation pattern extending only through said paperboard.

56. A package comprising:

a generally parallelepiped container including a top panel having spaced apart and parallel front and rear marginal edges connected by spaced apart and parallel first and second side marginal edges, said front marginal edge connecting first and second corners, said rear marginal edge connecting third and fourth corners, said first side marginal edge connecting said first and third corners, and said second marginal edge connecting said second and fourth corners;

said container further including a front panel having an upper marginal edge connected to said front marginal edge of said top panel, a rear panel having an upper marginal edge connected to said rear marginal edge of said top panel, a first side panel having an upper marginal edge connected to said first side marginal edge of said top panel, and a second side panel having an upper marginal edge connected to said second side marginal edge of said top panel;

said container further including tear line means having first and second tear lines located in said top panel and a third tear line located along said front side marginal edge of said top panel;

said first tear line extending alongside said first side marginal edge of said top panel and originating adjacent said first corner and terminating adjacent said third corner, the portion of said first tear line located between said first and third corners being spaced from said first side marginal edge;

said second tear line extending alongside said second side marginal edge of said top panel and originating adjacent said second corner and terminating adjacent said fourth corner;

said third tear line originating adjacent said first corner and terminating adjacent said third corner;

said first, second, and third tear lines cooperating to define a portion of said container to be opened such that, when said first, second, and third tear lines are severed, said openable portion remains hingedly attached along said rear marginal edge of said top panel;

said first tear line and said first side marginal edge of said top panel cooperating to define a first ear portion which, after said openable portion is disconnected along said first, second, and third tear lines, enables said first ear portion to be hinged upwardly about said first side marginal edge to provide further access to the contents of the container through the top panel thereof.

57. The package according to claim 56 wherein said third tear line is located in said first side panel.

58. The package according to claim 56 wherein said second tear line and said second side marginal edge of said top panel cooperate to define a second ear portion which, after said openable portion is disconnected along said first, second, and third tear lines, enables said second ear portion to be hinged upwardly about said second side marginal edge to provide further access to the contents of the container through the top panel thereof.

59. The package according to claim 58 including an opening tab connected to said openable portion of said container, said opening tab adapted to be grasped by a user of said container and pulled away from said container to cause said container to sever along said first, second and third tear lines and thereby open said container.

60. The package according to claim 59 wherein said opening tab substantially covers and protects said third tear line.

61. The package according to claim 60 wherein the ends of said first, second, and third tear lines are slightly spaced from the respective adjacent corners.

62. The package according to claim 61 wherein said paperboard is provided with a plastic coating on at least one surface thereof.

63. The package according to claim 62 wherein said first and second tear lines include a predetermined perforation pattern formed in said paperboard, said perforation pattern extending only through said paperboard.

64. A package comprising:

a generally parallelepiped container including a top panel having spaced apart and parallel front and rear marginal edges connected by spaced apart and parallel first and second side marginal edges, said front marginal edge connecting first and second corners, said rear marginal edge connecting third and fourth corners, said first side marginal edge connecting said first and third corners, and said second side marginal edge connecting said second and fourth corners;

said container further including a front panel having an upper marginal edge connected to said front marginal edge of said top panel, a rear panel having an upper marginal edge connected to said rear marginal edge of said panel, a first side panel having an upper marginal edge connected to said first side marginal edge of said top panel, and a second side panel having an upper marginal edge connected to said second side marginal edge of said top panel;

said container further including tear lines means having first and second tear lines located in said top panel and third tear line means located along said front side marginal edge of said top panel;

said first, second, and third tear lines cooperating to define a portion of said container to be opened;

said first tear line extending alongside said first side marginal edge of said top panel and originating adjacent said first corner and terminating adjacent said third corner;

said second tear line extending alongside said second side marginal edge of said top panel and originating adjacent said second corner and terminating adjacent said fourth corner;

said third tear line originating adjacent said first corner and terminating adjacent said third corner;

said first, second, and third tear lines cooperating to define a portion of said container to be opened such that, when said first, second, and third tear lines are severed, said openable portion remains hingedly attached along said rear marginal edge of said top panel;

an opening tab operatively connected to said openable portion of said top panel, at least a portion of said opening tab secured to said front panel and substantially covering said third tear line.

65. The package according to claim 64 wherein said third tear line is located in said first side panel.

66. The package according to claim 64 wherein the portion of said first tear line located between said first and third corners is spaced from said first side marginal edge of said top panel, and the portion of said second tear line located between said second and fourth corners is spaced from said second side marginal edge of said top panel, said first side marginal edge of said top panel and said first tear line cooperating to define a first ear portion and said second side marginal edge of said top panel and said second tear line cooperating to form a second ear portion such that, after said openable portion is disconnected along said first, second, and third tear lines, enables said first and second ear portions to be hinged upwardly about said first and second side marginal edge, respectively, to provide further access to the contents of the container through the top panel thereof.

67. The package according to claim 66 wherein the ends of said first, second, and third tear lines are slightly spaced from the respective adjacent corners.

68. The package according to claim 67 wherein said paperboard is provided with a plastic coating on at least one surface thereof.

69. The package according to claim 68 wherein said first and second tear lines include a predetermined perforation pattern formed in said paperboard, said perforation pattern extending only through said paperboard.

* * * * *